United States Patent [19]

Mitter

[11] 4,453,462

[45] Jun. 12, 1984

[54] APPLICATION OF A FOAMED TREATING MEDIUM TO A SHEET-MATERIAL WORKPIECE

[76] Inventor: Mathias Mitter, Schloss Holte, Fed. Rep. of Germany

[21] Appl. No.: 354,602

[22] Filed: Mar. 4, 1982

[30] Foreign Application Priority Data

Mar. 10, 1981 [DE] Fed. Rep. of Germany ..... 3108963

[51] Int. Cl.[3] ..... B05C 3/18; B05C 17/02; B41L 13/18; B41F 31/06

[52] U.S. Cl. ..... 101/124; 101/120; 101/364; 118/50; 118/213; 118/694

[58] Field of Search ..... 118/213, 406, 414; 101/121, 364, 123, 120, 124

[56] References Cited

U.S. PATENT DOCUMENTS

| | | | |
|---|---|---|---|
| 654,263 | 7/1900 | Lewis | 101/121 |
| 1,447,849 | 3/1923 | Hough | 101/364 |
| 1,509,888 | 9/1924 | Weldon | 101/364 |
| 1,896,034 | 1/1933 | Weed | 101/364 |
| 1,958,383 | 5/1934 | Naucler | 261/DIG. 26 |
| 2,326,459 | 8/1943 | Hansen | 101/121 |
| 2,363,137 | 11/1944 | Metcalf | 101/120 |
| 2,446,010 | 7/1948 | Jahn | 101/121 |
| 3,000,300 | 9/1961 | Ortleb | 101/364 |
| 3,047,418 | 7/1962 | Compton | 118/429 |
| 3,084,661 | 4/1963 | Roberts | 118/50 |

FOREIGN PATENT DOCUMENTS

| | | | |
|---|---|---|---|
| 432091 | 7/1926 | Fed. Rep. of Germany | 101/120 |
| 2722069 | 11/1978 | Fed. Rep. of Germany | 101/123 |
| 2951250 | 4/1980 | Fed. Rep. of Germany | 101/364 |
| 592517 | 5/1925 | France | 101/120 |
| WO79/00955 | 11/1979 | PCT Int'l Appl. | 101/364 |

*Primary Examiner*—Clyde I. Coughenour
*Attorney, Agent, or Firm*—Peter K. Kontler

[57] ABSTRACT

An applicator for applying a foamed treating medium to a sheet-material workpiece has a chamber through the open top of which the foamed medium is introduced, and an open bottom through which the foamed medium is discharged towards the workpiece to be treated. To assure that the upper surface of the foamed medium in the chamber is always maintained at a constant level, an equalizing member extends across the open top of the interior of the chamber, and a drive is provided which reciprocates or otherwise moves the equalizing member relative to the open top so as to smooth out any portions of the foamed medium which extend upwardly beyond the desired level.

25 Claims, 8 Drawing Figures

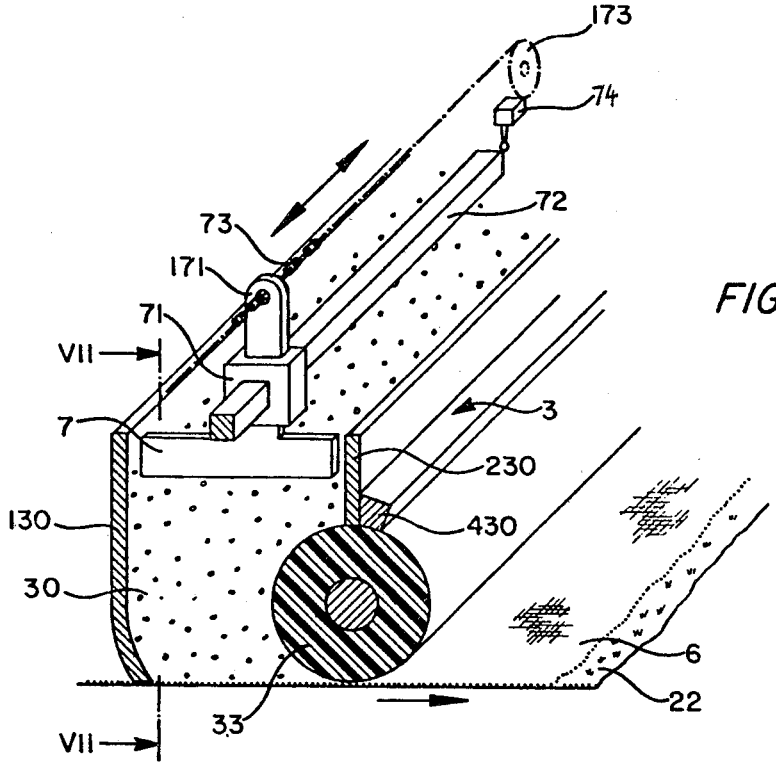
FIG. 2
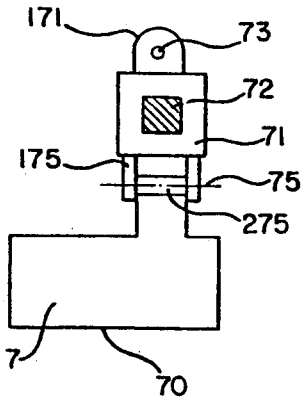
FIG. 3
FIG. 4
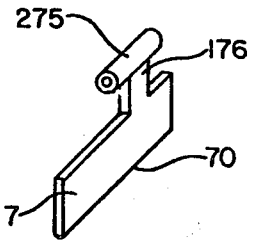
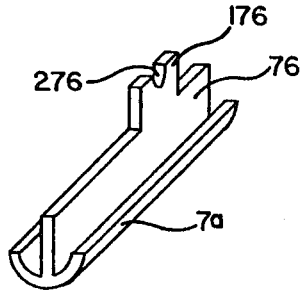
FIG. 5

APPLICATION OF A FOAMED TREATING MEDIUM TO A SHEET-MATERIAL WORKPIECE

BACKGROUND OF THE INVENTION

The present invention relates to the application of a treating medium to a workpiece.

More particularly, the invention relates to the application of a foamed treating medium to a workpiece.

Still more particularly, the invention relates to the application of a foamed treating medium to a sheet-material workpiece, especially a textile workpiece.

Yet more specifically, the invention relates to an applicator for applying the foamed treating medium to such a workpiece.

Foaming of a treating medium, and its application to a workpiece, are known from German Pat. No. 2,523,062. In that patent the foamed treating medium is admitted into the top of a box-shaped receptacle whose cross-section diverges sharply in direction away from the relatively small foam inlet of the receptacle. Baffles in the interior of the receptacle are to assure improved distribution of the foam.

This construction makes no provision for keeping the upper level of the admitted foam uniform—nor is there any need to do so since the distance between the foam inlet and foam outlet regions is relatively large, the cross-section of the box interior diverges in direction towards the foam outlet, and the foam volume is limited in the upward direction by the use of a box as the receptacle.

A problem is encountered, however, when relatively wide sheet- or band-material workpieces, especially textile workpieces, are to be printed, colored, coated or otherwise treated with foamed treating medium. To obtain high-quality results it is a requirement that there be assurance that the treating medium will penetrate into the substrate (i.e. the workpiece) to a depth which is uniform over the entire length and width of the workpiece as well as for the entire time-period of the production run. Hand in hand with this goes the further requirement to maintain completely uniform foam application conditions over long production periods, for example in the case of large production runs.

When the foamed treating medium is to be applied to a relatively wide workpiece, then evidently the chamber from which the medium is discharged onto or towards the workpiece must be of commensurate width. Admission of the treating medium into this chamber is simply a matter of discharging it into the chamber from a supply tube which is similar to the ink-supply tube used in a screen-printing machine but must, of course, have substantially larger outlet openings. Since all such foam, whether it is completely stable or slightly unstable, essentially refuses to flow, it is self-evident that underneath the tube outlet openings the foamed treating medium will form peaks—and that at these peaks the depth of foamed treating medium in the chamber will be greater than elsewhere. Accordingly, the prior art does not fulfill the above-mentioned essential requirement, namely that completely uniform foam application conditions be maintained for long production run periods over the entire width of the workpiece area to which the treating medium is being applied.

SUMMARY OF THE INVENTION

It is, accordingly, an object of the present invention to overcome the problems posed in the prior art.

A more particular object is to provide an improved applicator for applying a foamed treating medium to a sheet-material workpiece. It should be noted that, as used herein, the term "sheet-material" is intended also to include all band-material (webs) and that the invention, although especially well suited for use with textile materials, is not limited thereto.

Another object of the invention is to provide such an improved applicator which is relatively simple in its construction, and which is therefore comparatively inexpensive.

A concomitant object of the invention is to provide an applicator of the type under discussion, which is reliable in operation and not given to malfunctions.

Still a further object is to provide an applicator as mentioned above, which is suitable for retrofitting of existing machinery and which, when so used, requires relatively little time and effort for the retrofitting installation.

In keeping with these objects, and with still others which will become apparent hereafter, one aspect of the invention resides in an applicator for applying a foamed treating medium to a sheet-material workpiece. Briefly stated, such an applicator may comprise first means (e.g. walls) bounding a chamber having an open top through which the chamber receives a foamed treating medium, and an open bottom through which foamed treating medium is discharged towards a workpiece. Second means (e.g. a doctor blade or the like) may be provided, extending across the interior of the chamber in the region of the open top. And third means (e.g. a reciprocating or rotary drive) may be present for displacing the second means relative to the chamber in the aforementioned region so as to maintain the foamed medium in the chamber at a uniform upper level.

The importance of the invention must be seen in the context of foamed treating media. Where non-foamed media are used, such as for example viscous printing paste in screen-printing machines, the problems outlined earlier herein do not occur since the flowable consistency of the medium assures self-levelling of the medium. On the other hand, however, it is not possible to avoid these problems by simply using non-foamed treating media in all applications, since the use of foamed media offers many and important advantages over those obtainable from the use of non-foamed media. The problem must, therefore, be dealt with by correction—and this correction is what the present invention provides.

The novel features which are considered to be characteristic of the invention are set forth in particular in the appended claims. The improved applicator itself, however, together with its construction and mode of operation, as well as additional features and advantages thereof, will be best understood upon a perusal of the following detailed description of specific although purely exemplary embodiments with reference to the accompanying drawing.

BRIEF DESCRIPTION OF THE DRAWING

FIG. 2 is a fragmentary perspective view, partly in section, showing the applicator of FIG. 1 on an enlarged scale;

FIG. 3 is a partly sectional view, showing a detail of another embodiment of the invention;

FIG. 4 is a perspective view of a component from the embodiment in FIG. 3;

FIG. 5 is a view analogous to that of FIG. 4 but showing a component from a further embodiment;

DESCRIPTION OF PREFERRED EMBODIMENTS

Figure 1:
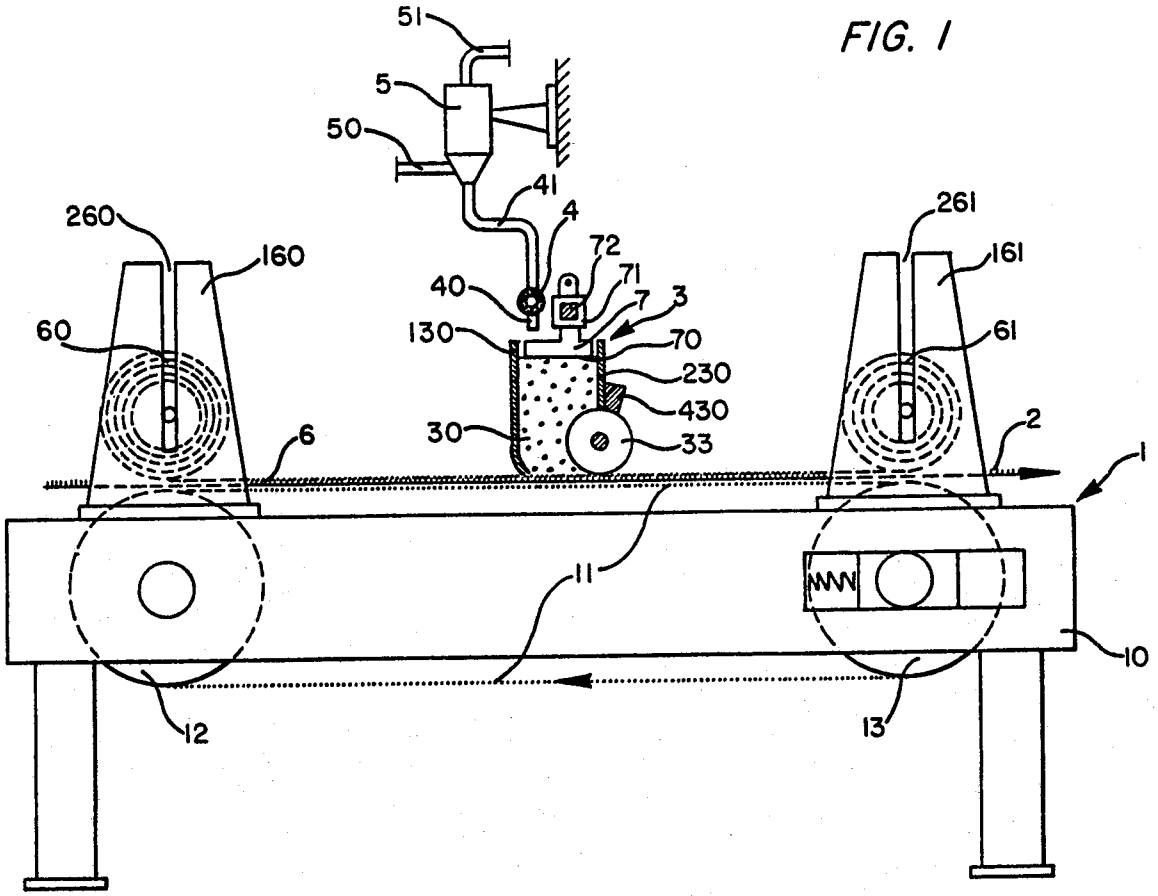
FIG. 1 is a somewhat diagrammatic side elevational view, illustrating a machine incorporating an embodiment of the inventive applicator.

Referring now to the drawing in detail, and firstly to the embodiment illustrated in FIGS. 1 and 2, it will be seen that these Figures show a machine 1 on which the applicator according to the invention is to be used. This machine, which may for example be a screen-printing machine but could be any other type of machine requiring such an applicator, has a frame 10 provided with a workpiece transporting arrangement. In the illustrated embodiment the transporting arrangement includes an endless printing blanket 11 trained about two rollers 12 and 13, at least one of which is driven. The workpiece 2, in form of sheets or webs of material to be treated, is fed onto the upper run of the printing blanket 11 which carries it underneath the inventive applicator 3. The applicator 3 has a chamber 30 which is closed by circumferential walls and has an open top through which foamed treating medium enters the chamber, and an open bottom through which the foamed treating medium leaves the chamber.

The circumferential walls bounding the chamber 30 include, as considered in the direction of workpiece movement (see the arrow in FIG. 1), an upstream wall 130 and a downstream wall 230; both of these walls extend over the entire workpiece width which is to have treating medium applied to it. The circumferential walls further include two end walls 330 (FIG. 8) which are preferably both so mounted that they can be moved towards and away from each other, so that the length of the chamber 30 can be accommodated to the width of the workpiece (or at least to the width of the workpiece area to be treated). The upstream side wall 130 extends down to the workpiece 2, whereas the downstream wall 230 extends only to the illustrated roller squeegee 33 and has a sealing portion 430 which straddles and sealingly engages the roller squeegee 33 (which it must not, of course, prevent from turning). The roller squeegee, known per se in the printing machine art, may be positively driven or it may be replaced with a doctor blade. It is also possible to have the wall 230 extend all the way down to the workpiece 2, similar to the wall 130; in that case the printing blanket must be gas-permeable and a suction box (known per se and not shown) will be arranged underneath its upper run to draw the treating medium into the (also permeable) workpiece 2.

To operate the device in FIGS. 1 and 2, foamed treating medium is introduced into the chamber 30 through the open top of the same. This admission of the treating medium can be effected in any of several known-per-se ways. For example, a supply tube 4 can extend across the open top of the chamber 30 and have a plurality (one shown) of outlet nipples 40 of sufficiently large diameter to permit proper discharge of the foamed treating medium. Such outlet nipples will be arranged on the tube 4 over the entire width of the workpiece area to be treated, preferably evenly spaced from one another. A hose or pipe 41 supplies the foamed medium to the tube 4 from a mixing chamber 5 which in turn receives liquid to be foamed through a pipe 50 and compressed air through a pipe 51. Several kinds of such mixing chambers are known per se in the art; it will suffice to mention just one suitable construction, namely that disclosed in German Pat. No. 2,523,062. The pipes 50 and 51 have each installed in them (not shown in the drawing) respective volume-metering and volume regulating devices, valves for the liquid and the compressed air, an adjustable pump and other equipment which is known per se in conjunction with the known mixing chambers and which forms no part of the present invention.

If desired, a screen 6 having e.g. a uniform surface structure, may be advanced atop of and along with the workpiece 2, being paid out from a roller 60 and taken up on a roller 61. The shafts of the rollers 60, 61 are guided in slots 260, 261 of the sidewalls 160, 161. The bubbles of the foam become ruptured and destroyed at the interface of the foam and the workpiece, thereby liberating their entrapped liquid treating medium. If, however, the workpiece surface is relatively rough, then the bursting of the bubbles—and the liberation of the liquid—will not be uniform over the workpiece area. The use of the uniform-surface screen 6 is intended to assure that such uniformity of liquid-liberation is attained even with rough-surfaced (i.e. uneven-surfaced) workpieces, since now the bursting of the bubbles will occur at the interface of the foam and the uniform-surfaced screen.

The applicator according to the invention can also be installed within the confines of a rotary or travelling-belt type of printing screen, if it is to be used in the context of a screen-printing machine, for example of the type disclosed in German Pat. No. 2,258,892. The printing screen itself will then perform the function of the above-mentioned screen 6, being located between the applicator 3 and the workpiece 2.

As mentioned before, the essence of the invention is to assure that the upper level of foamed treating medium in the chamber 30 will always be uniform and that there will be no peaks and valleys in this level. According to the invention this is achieved by providing a level equalizer 7 which extends transversely across the upper region of the open top of chamber 30. Equalizer 7 has a straight lower edge 70 extending from the wall 130 to the wall 230; the equalizer has an upstanding arm 176 (as shown in FIG. 5) which is clamped or otherwise secured to a slide member 71. The latter, in turn, has a square, rectangular or otherwise polygonal opening through which extends a bar or rod 72 of mating cross-section, so that members 7 and 71 can reciprocate with the suitably mounted bar 72. A drive (see FIG. 2) engages the member 71 to impart reciprocation to it and via it to bar 72. Broadly speaking, of course, the member 71 might itself already be considered to be the drive for the member 7. Any type of drive capable of imparting the desired movement, is of course suitable.

The applicator in FIG. 1 is shown in enlarged scale in FIG. 2 which, however, omits the machine per se since the machine itself is not part of the invention. The "drive" will be seen in FIG. 2 to be a chain 73 which is secured to an upstanding lug 171 of the slide member 71 and is trained about chain sprockets 173 (only one shown). At the opposite ends of the reciprocatory path permitted for the bar 72, there are provided limit switches 74 (known-per-se) which, when tripped by contact with the bar 72, cause the chain 73 to reverse its direction. The limit switches could also be of the contactless type (proximity switch) which is similarly known per se. In this manner the equalizer is made to reciprocate to and fro between the walls 130 and 230 (i.e. in direction normal to the plane of FIG. 1) and its lower edge 70 will constantly smooth out the upper surface of the foam in chamber 30, thus maintaining a uniform foam level.

The arm 176 is provided off-center on the equalizer 7, so as to avoid interference with the tube 4 and its nipples 40.

In the embodiment of FIGS. 3 and 4 the equalizer 7 is the same as or similar to the equalizer 7 in the first embodiment. It differs from that embodiment in that in FIG. 3 the equalizer is mounted for swinging movement. For this purpose the slide member 71 is provided with a pair of downwardly extending transversely spaced lugs 175 defining between themselves a space. The upper end of arm 176 on equalizer 7 is provided with a tubular formation 275 (compare FIG. 4) through which a rod, pin or the like (not shown) is pushed to have its opposite ends secured in the respective lugs 175, so that the formation 275 and thus the equalizer 7 can swing about the axis 75 of this rod or pin. An advantage of this embodiment is that, when the slide member 71 is being moved e.g. to the right, the equalizer 7 will swing leftwards (due to friction) to rest on the surface of the foamed treating medium in chamber 30, thus assuming an angular position which is especially advantageous for levelling the upper surface of the treating medium; the reverse of course is true when the direction of movement of the member 71 is reversed.

FIG. 5 shows an embodiment in which the equalizer 7*a* has the shape of a skid or pressure pad composed of a curved bottom part and an upstanding center part 76. Again the center part is provided with arm 176 which is off-center for the reasons already explained. In other respects the embodiment of FIG. 5 may resemble any of the preceding embodiments. Like them, it may have notch 276 in the arm 176, for securement of the arm to the slide member 71.

Figure 6:
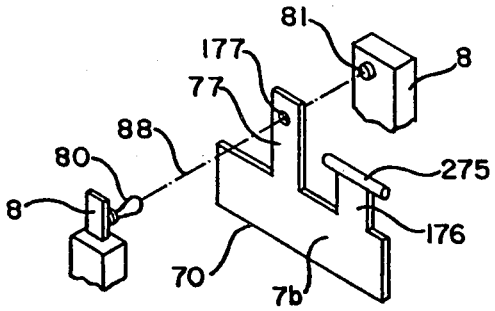
FIG. 6 is a perspective view, illustrating a component from yet another embodiment which is provided with a foam-level sensor.

In the embodiment of FIG. 6 the equalizer 7*b* can again be of any configuration suitable for the purpose, e.g. a flat board-shape, a profiled shape, a tubular shape, a skid-shape, or the like. For purposes of explanation a flat board shape is shown, similar to the one in FIGS. 1–4. This equalizer 7*b* is mounted in the manner shown in FIGS. 3 and 4, i.e. for swinging movement, for which purpose the arm 176 is provided with the tubular formation 275.

In addition to the arm 176 the equalizer 7*b* also has a second arm 77 which is provided with a hole 177. The hole 177 cooperates with a level-control sensor 8 which may be of any known-per-se construction. In the illustrated embodiment the sensor 8 comprises a light source 80 located at one side of the arm 77 and a receiver 81 located at the other side of the arm 77. Light source and receiver are so aligned that in normal and proper operation of the equalizer 7 the light beams 88 from source 80 pass through the hole 177 and impinge upon the receiver 81. Should malfunction occur and foamed medium mound up beyond the desired upper medium level in chamber 30, then the equalizer 7*b* will swing over to one side or the other (depending upon the direction of movement of the slide member 71) until the light beams 88 can no longer pass through the hole 177. The receiver 81 detects the absence of light beams and shuts down the admission of the foamed medium into the top of the box-shaped receptacle. Since the application of the foamed treating medium continues, the upper level of the foamed medium will sink below the desired level in the chamber 30 and the equalizer 7*b* will swing back to the position in which the light can pass through the hole 177. The receiver 81 detects the light beam 88 and turns on the admission of the foamed medium.

Figure 7:
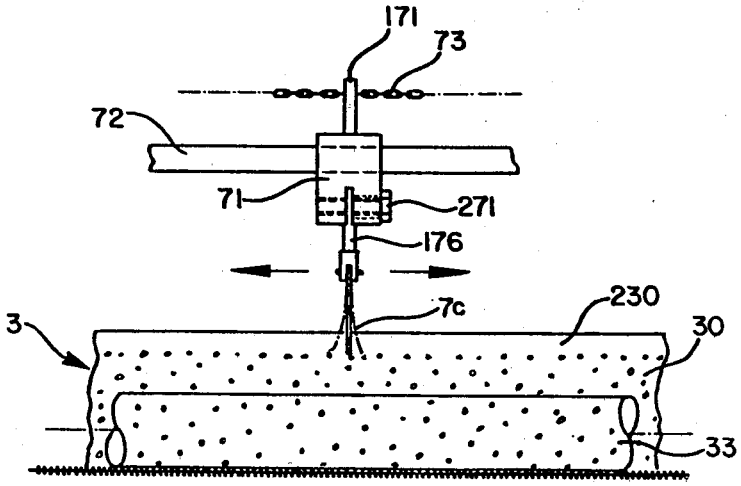
FIG. 7 is a section taken generally on line VII—VII of FIG. 2 but showing a somewhat modified embodiment.

FIG. 7 shows an embodiment similar to FIG. 2 (on section line VII—VII of that Figure) but with an equalizer 7*c* which is flexible and is fixedly mounted on member 71 by means of a screw 271 so as to be easily removable for inspection, cleaning and/or replacement. Depending upon the direction in which the member 71 is being moved, the flexible equalizer 7*c* will bend (flex) to one or the other of the two indicated broken-line positions, due to the frictional resistance offered it by the foamed medium present in chamber 30; in so doing, it will smooth the top of the foamed medium and maintain the upper level thereof uniform.

Figure 8:
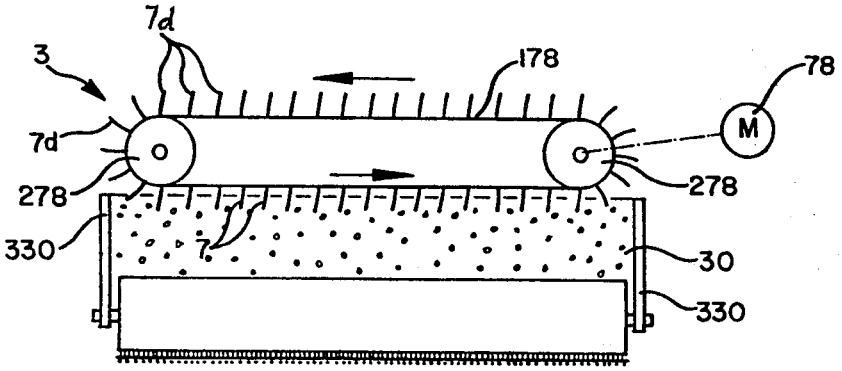
FIG. 8 is a diagrammatic sectional view illustrating an additional embodiment of the invention.

FIG. 8, finally, shows a embodiment which utilizes a rotary drive, here in form of motor 78 with e.g. a suitable (not illustrated) transmission. In this embodiment the motor need not be reversible; however, a motor can also be used in e.g. the embodiments of FIGS. 1–7 and must, in that case, be of the reversible type.

To return to FIG. 8, in this embodiment the motor 78 always turns in one direction and thus drives an endless band or belt 178 also always in one direction, namely that indicated by the arrow. Band 178 is trained about rollers 278 and carries spaced along it a plurality of the equalizers 7*d*, as shown. Again, any of the earlier-mentioned shapes may be chosen for the equalizers; the flat board shape is shown in FIG. 8 only for the sake of explanation. The equalizers may also be curved to a shovel shape or one or more of them (only one shown) may have such a shape and be intermixed with others having a different shape, as shown in FIG. 8. Should there be a reason to assume that the foam in chamber 30 tends to shift towards one side, then the band 178 can be made to reciprocate in toto, in which case it must of course be sufficiently smaller than chamber 30 to permit such movement.

Although most of the illustrated embodiments show the equalizer acting upon the surface of the foam in chamber 30, it may be advantageous to immerse and move the equalizer within the upper region of the foam (compare FIG. 8) in order to e.g. protect the consistency of the foam and delay its decomposition.

The essential aspect of the invention is to provide an instrumentality, of whatever shape, which moves relative to the upper surface of the foam in the chamber 30 in order to equalize the upper foam level and maintain it uniform. It is, of course, advantageous for the underside of this instrumentality, i.e. the side which contacts the foam, to be smooth although slight grooving is acceptable so long as it is not sufficiently deep (not sufficiently angled to the direction of movement of the equalizer) to cause the bursting of the foam bubbles (this can readily be empirically determined).

The invention is susceptible of various modifications and changes. For example, any type of squeegee other than the roller squeegee 33 of FIG. 1, can be employed. A particularly advantageous combination in the context of a screen-printing machine, is the use of a roller squeegee (such as shown in FIG. 1) with a suction box (not shown) underneath the printing blanket.

Level adjustment, in order to select the precise level at which the equalizer 7 is to operate, can be effected by adjusting the level of the rod 72 by continuous adjustment of its end supports, or by adjustment of the level of the rollers 278. The reason for making the rods 72 polygonal is to prevent them from turning and thereby placing the equalizer 7 in a canted position. However, the rods 72 may be turned in their end supports so that they can be slightly inclined if desired.

The applicator according to the present invention serves to apply the foamed treating medium to the workpiece, directly or via a screen (such as screen 6) or a printing screen (if the invention is used in the context of a screen-printing machine). Any screen used may be patterned or unpatterned, depending upon whether the medium is to be applied to the workpiece in a pattern or as an unvaried coating. The use of any type of screen has the advantage that the medium is applied to the workpiece as a liquid (since the foam bubbles burst at the upper surface of the screen and set free the liquid entrapped in them), rather than contacting the workpiece surface as foam bubbles per se.

A particularly important area of use for the inventive applicator is with screen-printing and analogous machines in order to assure that the variable use of foam is compensated for as well as the often varying supply of foam.

The novel applicator can be used with the most diverse foamable treating media. For example, in the case of printing machines the medium to be foamed may be printing ink in liquid, viscous or other form, used for printing or coloring a workpiece. However, it is also possible to foam latex and apply it to the workpiece as a coating. Again, fire-proofing, moth-proofing and other liquids can be foamed and applied with the inventive applicator.

The substrate to be treated, i.e. the workpiece, may with particular advantage be fibrous material, such as a textile, (e.g. carpet, napped material such as velvet, fibrous roving, felt). Non-woven materials can also be processed, as well as paper and synthetic plastic foil materials (which are e.g. to be coated with the treating material).

Depending upon the results to be attained the foamed treating medium in chamber 30 is either smoothed only at its upper surface, or else the equalizer is set to penetrate somewhat into it. The chamber 30 may be located ahead of any desired device for applying the medium onto (or into) the workpiece; it can itself in part constitute the applying device (e.g. the roller squeegee 33 or a slot-type squeegee or a doctor blade) or be integrated therewith.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and indeed are intended to be comprehended within the meaning and scope of equivalence of the appended claims.

I claim:

1. An applicator for applying a foamed treating medium to a sheet-material workpiece, particularly a fibrous textile, comprising first means bounding a chamber having an open top and an open bottom; means for supplying foamed treating medium into said chamber via said open top so that the treating medium is discharged towards a workpiece by way of said open bottom; level equalizing second means extending across said chamber in the region of said open top; third means for displacing said second means relative to said chamber in said region so as to maintain the foamed medium in said chamber at a uniform upper level; and means for sensing the upper level of foamed treating medium in said chamber and for interrupting the admission of additional foamed treating medium via said open top when the sensed upper level is above a predetermined level.

2. An applicator as defined in claim 1, said third means comprising a reciprocatory drive.

3. An applicator as defined in claim 1, said third means comprising a rotary drive.

4. An applicator as defined in claim 1; and further comprising adjusting means for adjusting the vertical position of said second means relative to said chamber.

5. An applicator as defined in claim 1; and further comprising mounting means swingably mounting said second means on said third means so that said second means can assume different inclined positions relative to said level, depending upon the direction of displacement of said second means by said third means.

6. An applicator as defined in claim 1, said second means including a slide member mounted for sliding movement along said open top; and further comprising mounting means mounting said second means on said slide member so that said second means can assume different inclined positions relative to said level, depending upon the direction of displacement of said second means by said third means.

7. An applicator as defined in claim 1, said second means comprising an elastically yieldable doctor blade.

8. An applicator as defined in claim 1, said second means comprising a rigid at least substantially flat member mounted in upright orientation.

9. An applicator as defined in claim 1, said second means comprising a rigid member having the shape of a skid.

10. An applicator as defined in claim 9, said rigid member having a lower skid portion, a center portion extending up from said skid portion, and an upper mounting portion extending up from said center portion.

11. An applicator as defined in claim 1, said second means comprising a leveling member having an off-center upstanding arm, and a slide member mounted for sliding movement along said open top, said mounting arm being connected to said slide member; and said third means comprising a rod at least generally paralleling said open top and extending through said slide member so as to mount the slide member for movement along said rod.

12. An applicator as defined in claim 1, said second means comprising a leveling member having an edge portion which in part bounds a recess through which beams of a level-control device are adapted to pass.

13. An applicator as defined in claim 12, said leveling member including an upstanding lug projecting from an upper portion of the leveling member, and said edge portion being provided on said lug.

14. An applicator as defined in claim 13, said edge portion bounding a hole.

15. An applicator as defined in claim 1, said second means comprising a leveling member having an upper edge and a lower foam-contacting edge, said lower edge being smooth.

16. An applicator as defined in claim 1, said second means comprising a leveling member having an upper edge and a lower foam-contacting edge, said lower edge having shallow flutes formed therein.

17. An applicator as defined in claim 1, said third means including an endless belt and a drive for effecting advancement of said belt relative to said open top, said second means including at least one leveling member mounted on said endless belt for movement therewith.

18. An applicator as defined in claim 17, said second means including a plurality of additional ones of said leveling members, all of said leveling members being mounted on said belt spaced along the same and from one another.

19. An applicator as defined in claim 17, said third means further comprising mounting rollers about which said belt is trained, and said drive including an electric motor operatively connected with said belt for driving the same relative to said open top.

20. An applicator as defined in claim 17, said third means further comprising mounting rollers about which said belt is trained, and said drive including an electric motor operatively connected with said belt for reciprocating the same relative to said open top.

21. An applicator as defined in claim 1, said third means comprising an endless flexible element, rollers about which said element is trained to define a path of movement for said second means, and a drive for entraining said element; and a pair of limit switches each located at one end of said path of movement and connected with said drive for reversing the direction of operation thereof when said second means reaches the respective path end.

22. An applicator as defined in claim 1, said first means including a plurality of walls, and one of said walls incorporating a squeegee roller.

23. An applicator as defined in claim 1; and further comprising a suction box mounted below said open bottom of said chamber, sufficiently spaced therefrom to permit the passage of the workpiece therebetween.

24. An applicator as defined in claim 1; and further comprising a screen on top of the workpiece.

25. An applicator as defined in claim 24, wherein said screen has first and second end portions and further comprising spaced apart first and second rollers connected with the respective end portions of said screen and having shafts, and first and second sidewalls having slots for the shafts of the respective rollers, said screen engaging the top of the workpiece between said rollers.

* * * * *